United States Patent [19]

Peltier

[11] Patent Number: 4,695,957

[45] Date of Patent: Sep. 22, 1987

[54] DRILLING MONITOR WITH DOWNHOLE TORQUE AND AXIAL LOAD TRANSDUCERS

[75] Inventor: Bernard P. J. M. Peltier, Chesterton, England

[73] Assignee: PRAD Research & Development N.V., Curacao, Netherlands

[21] Appl. No.: 750,562

[22] Filed: Jun. 27, 1985

[30] Foreign Application Priority Data

Jun. 30, 1984 [GB] United Kingdom ..... 8416708

[51] Int. Cl.[4] ..... E21B 44/00; E21B 47/12

[52] U.S. Cl. ..... 364/422; 73/151; 175/40; 340/853

[58] Field of Search ..... 364/422; 340/853; 73/151; 175/40; 367/81, 82

[56] References Cited

U.S. PATENT DOCUMENTS

| | | | |
|---|---|---|---|
| 3,968,473 | 7/1976 | Patton et al. | 367/83 |
| 4,064,749 | 12/1977 | Pittman et al. | 73/152 |
| 4,285,236 | 8/1981 | Chien | 73/151 |
| 4,303,994 | 12/1981 | Tanguy | 367/35 |
| 4,359,898 | 11/1982 | Tanguy et al. | 73/151 |
| 4,507,735 | 3/1985 | Moorehead et al. | 364/422 |
| 4,549,431 | 10/1985 | Soeiinah | 73/151 |
| 4,562,559 | 12/1985 | Sharp et al. | 367/82 |
| 4,592,033 | 5/1986 | Dennis | 340/853 X |

FOREIGN PATENT DOCUMENTS

| | | | |
|---|---|---|---|
| 1439519 | 6/1976 | United Kingdom . | |
| 2091921 | 8/1982 | United Kingdom | 340/853 |

OTHER PUBLICATIONS

European Patent search report for publication No. 168,996, based on application No. 85,304,583, published Jan. 22, 1986.

*Primary Examiner*—Jerry Smith
*Assistant Examiner*—Clark A. Jablon

[57] ABSTRACT

In a drilling monitor downhole transducers provide signals representative of torque (T) and axial load (F). A downhole computer apparatus (5) receives the torque and load signals and computes coefficients representative of drilling conditions. These coefficients may then be combined into a surface sendable signal indicative of drilling conditions.

Signals representing T and F are received from downhole transducers (1,2) at input ports (3,4) of the downhole computer (5). From T and F measurements a relationship between T and F may be established, based on short term modeling. From the system model, torque may be predicted and correlated with the measured values received from the torque transducer (1). Values from the coefficients are computed and combined for sending from a transmitter (6) to a receiver (7) over a single low speed telemetry channel (8) for display and recording at the surface.

5 Claims, 6 Drawing Figures

70
71
72
TORQUE (N.m)
6000
5000
4000
3000
2000
1000
0
AXIAL LOAD (kN)
0
25
50
75
100
125
150
175
200
225

DRILLING MONITOR WITH DOWNHOLE TORQUE AND AXIAL LOAD TRANSDUCERS

This invention relates to drilling monitors, and in particular to monitors for detecting drilling events, such as, for example, sudden lithology change or drill bit failure.

In a drilling operation instrumentation may be applied to the drilling rig and data recorded to enable drilling performance to be analysed. For example, torque applied to a drill bit and applied axial load may be measured by downhole transducers. From data from previous measurements it has been found that when drilling conditions are substantially constant a model of the system may be set up so that, for example, a relationship between torque and axial load may be established. As drilling conditions change, the established relationships will no longer be valid and hence there will be a significant difference between actual measurements and predictions made by using the system model. If the model is updated as drilling continues, sudden changes in system parameters will be evident when a drilling event occurs. Unfortunately, the large amount of data to be recorded and the extensive computations needed to run a model limit the use of such an approach to post mortem analysis and to systems with hard wired high speed telemetry. For example, to record torque and axial load requires a high speed telemetry link to the surface and is not possible with the limited speed telemetry practicable on an operational drilling rig.

A drilling monitor is required to detect events which can be small. For example, the increased power consumption in a failing bearing might be 3 KW, whereas a typical overall drilling power would be 30 KW. Detection of such small events clearly compounds the problem of providing a monitor at the surface.

According to the present invention a drilling monitor includes downhole transducers for providing signals representative of torque and axial load, downhole computing means adapted to receive the torque and load signals and to compute therefrom coefficients representative of drilling conditions and means for combining said coefficients into a surface sendable indicative of drilling conditions.

Preferably the computing means is arranged to calculate the coefficients by implementing a curve fitting algorithm on a function which models the operation to transducer signal samples over a sample period and to continuously update the coefficients. The computing means is advantageously arranged to implement a model of the drilling system and to compute a correlation value between predicted values of torque and load and measured values of torque and load. The means for combining coefficients is advantageously adapted to receive the correlation value and further combine it with the coefficients to provide the sendable signal.

In a preferred embodiment of the present invention, signal compression and noise reduction means are arranged to act on the sendable signal, which may then be surface transmitted via a telemetry link.

In order that features and advantages of the present invention may be appreciated, some typical drilling histories and an embodiment of the present invention will now be described by way of example only with reference to the accompanying diagrammatic drawings of which:

In a typical drilling history (FIG. 2), downhole torque (T) and axial load (F) are recorded against time. From previous analysis of drilling parameters it has been found that bit torque is independent of rotation speed and that a straight forward model of the relationship between T and F is:

$$T=a_0F+a_1F^2$$

where $a_0$ and $a_1$ are constants. In the case of small variations of F this expression may be simplified to $$T=a_0+a_1F$$

to fit a small portion of the curve over a history of (T, F) values provided drilling conditions are assumed substantially constant. Histories of $a_0$ and $a_1$ are presented in FIG. 2 computed over a moving 10 second sample window, i.e. the plotted value is that which best fits the (T, F) relationship defined above to the actual values over the immediately past 10 seconds. Using the instantaneous system model, a value for torque may be predicted from measured axial load. Also computed is the correlation of the model with the data included in the moving window. The correlation of a system output y (torque T in the present case) with a system input x (axial load F) over a sampling window of interest may be defined as:

$$R=\sqrt{\frac{\text{variance explained by the model}}{\text{Total variance}}}=\sqrt{\frac{\Sigma(y_{est}-\bar{y})^2}{\Sigma(y-\bar{y})^2}}$$

where $$\bar{y}=\frac{1}{M}\cdot\sum_{i=1}^{M} i$$

$y$ and $M$ represents the number of samples in the sampling window.

In practice the variances are computed with the following iterative algorithm:

$$s_n^2=\frac{n-1}{n}\cdot s_{n-1}^2+\frac{1}{n-1}\cdot(y_n-\bar{y}_n)^2$$

Figure 2:
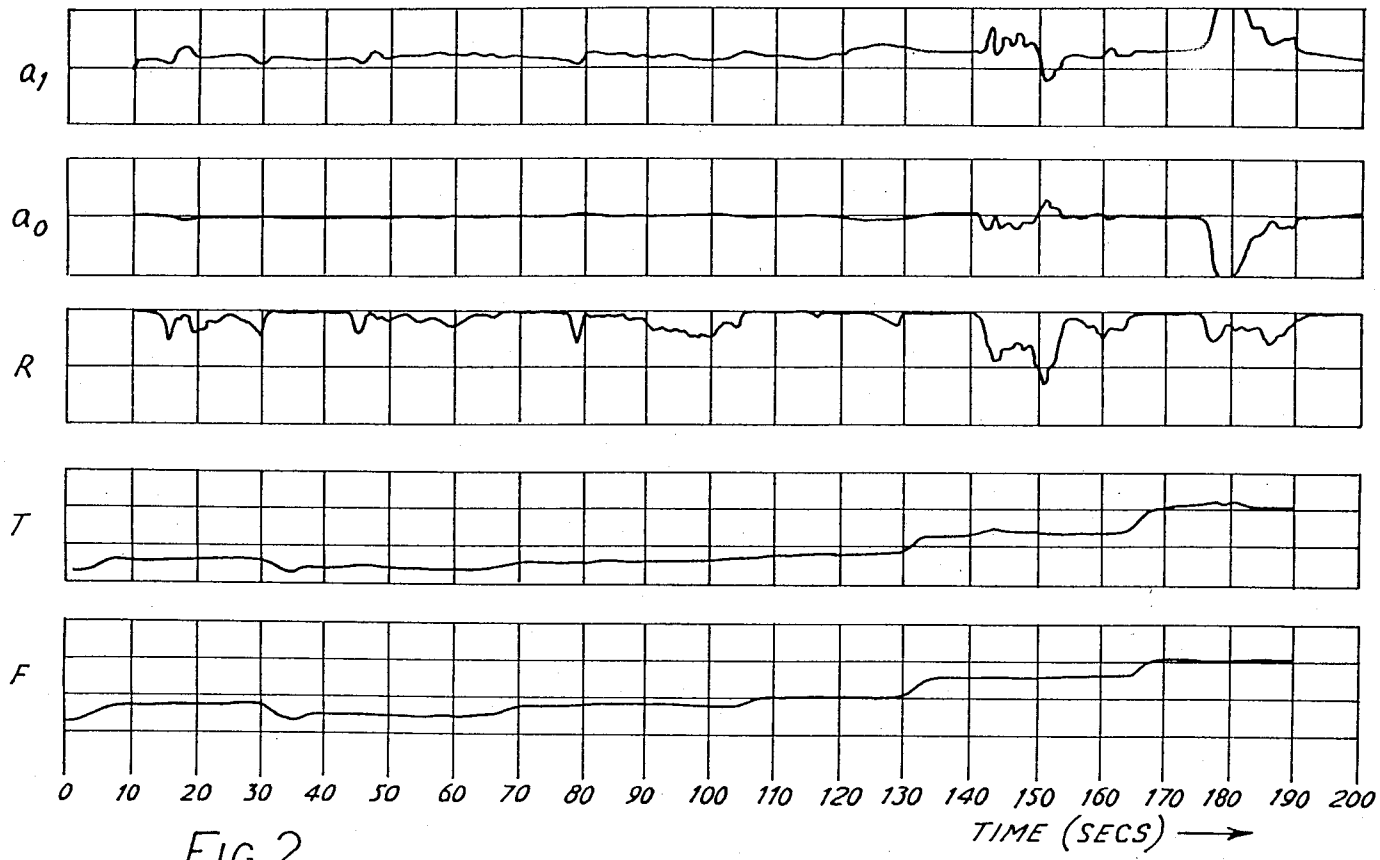
FIG. 2 represents a typical drilling time history.

This correlaton R is plotted against time in FIG. 2.

In the drilling operation to which the plots relate, the load was increased to approximately 150 KN after 130s which caused overloading and heating of a drill bit roller cone bearing. It will be noted that up to this time the torque coefficients $a_0$, $a_1$ were fairly stable, but vary rapidly following the drilling event. The large deviation in R will also be noted. It will be appreciated that currently such analysis can only be performed as a post mortem and requires a telemetry capability which is not commercially practicable on an operational drilling rig.

Figure 1:
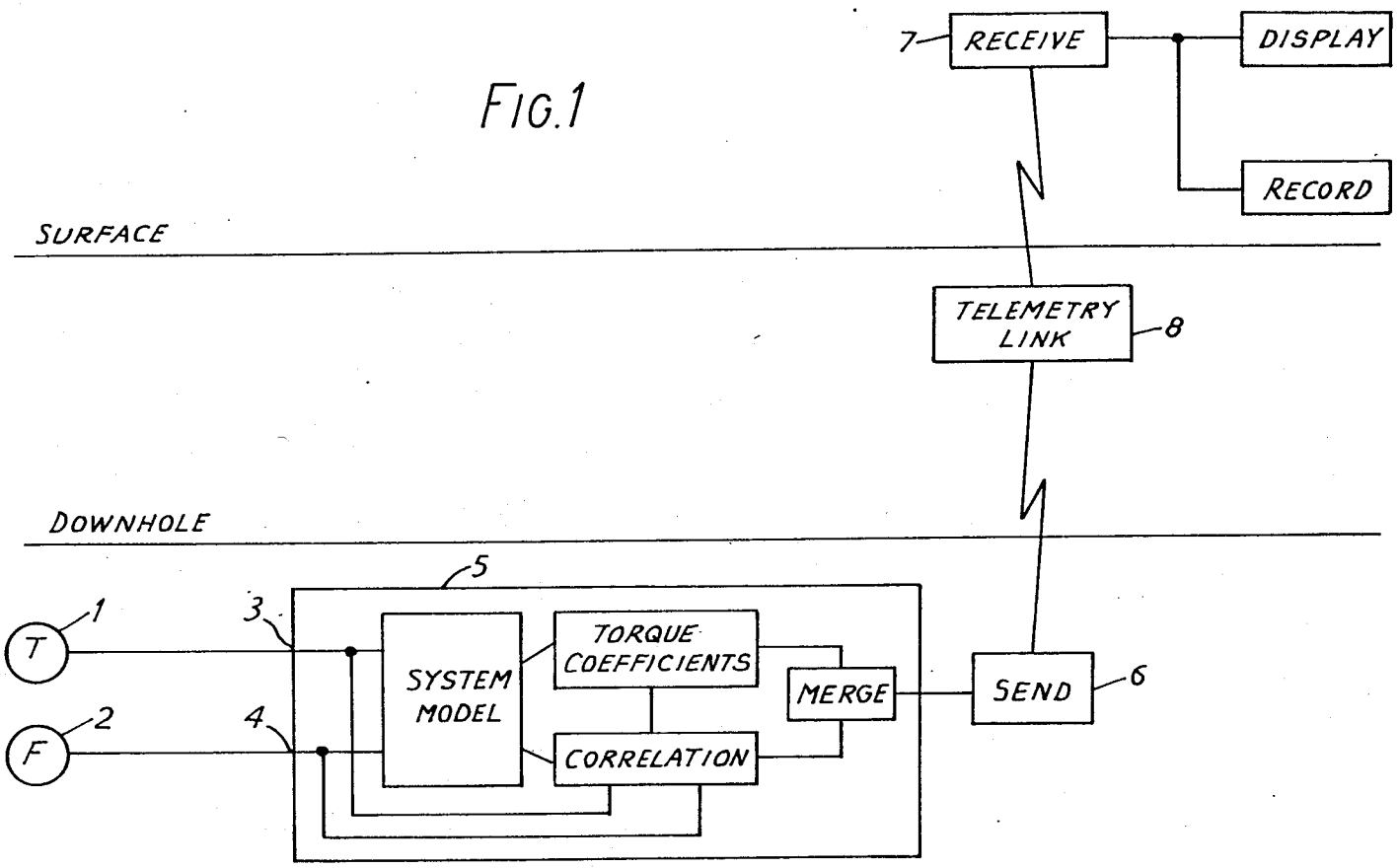
FIG. 1 is a block diagram of a drilling monitor.

In accordance with the present invention, signals representing T and F are received from downhole transducers 1, 2 (FIG. 1) at input ports 3, 4 of a downhole computer 5 respectively. As previously described, from T and F measurements a relationship between T and F may be established, based on a short term model. The model used in the present embodiment is the simple linear regression:

$$T=a_0+a_1F$$

From the system model, torque may be predicted and correlated with the measured values received from transducer 1. Values for $a_0$, $a_1$, and R computed in accordance with the present model are plotted in FIG. 2, wherein the occurrence of the drilling event in the $a_0$, $a_1$ and R channels may be noted. It will be realised that although these parameters may be computed downhole, the high data rate required to make available at the surface would be impracticable. Instead the parameters, are merged for sending from a transmitter 6 to a receiver 7 over a single low speed telemetry channel 8 for display and recording at the surface.

A straightforward way to merge the event detection potential of the parameters is to multiply them together and send the result to the surface i.e. letting the instantaneous value of the signalling channel be s:

$$s=a_0a\cdot a_1\cdot(1-R).$$

The signal to noise ratio of the signal channel may be improved if the mean value of each parameter ($a_{0m}$, $a_{1m}$) over the immediate part is subtracted, i.e.

$$s=(a_0-a_{0m})\cdot(a_1-a_{1m})\cdot(1-R).$$

As $a_0$ is negative for an increase in torque and $a_1$ positive, the absolute value of the first term need only be considered, i.e.

$$s=|(a_0-a_{0m})|\cdot(a_1-a_{1m})\cdot(1-R).$$

By continuously updating the means $a_{0m}$, $a_{1m}$, the signal s is increased only at the beginning of a drilling event but decreased thereafter if the mean is not computed over a longer duration than the event duration. As event duration cannot be predicted the full benefit of this approach cannot be realised, however, a worthwhile compromise is to hold the means constant ($a_{0mf}$, $a_{1mf}$) whenever a predetermined value $S_T$ is exceeded, and subsequently update the means when the signal value and the current signal vaue mean both fall below the predetermined value. Hence during an event:

$$s=|(a_0-a_{0mf})|\cdot(a_1-a_{1mf})\cdot(1-R).$$

Thus the length of the period used for updating the means defines the length of events which can be detected and the predetermined value additionally effects sensitivity.

Figure 3:
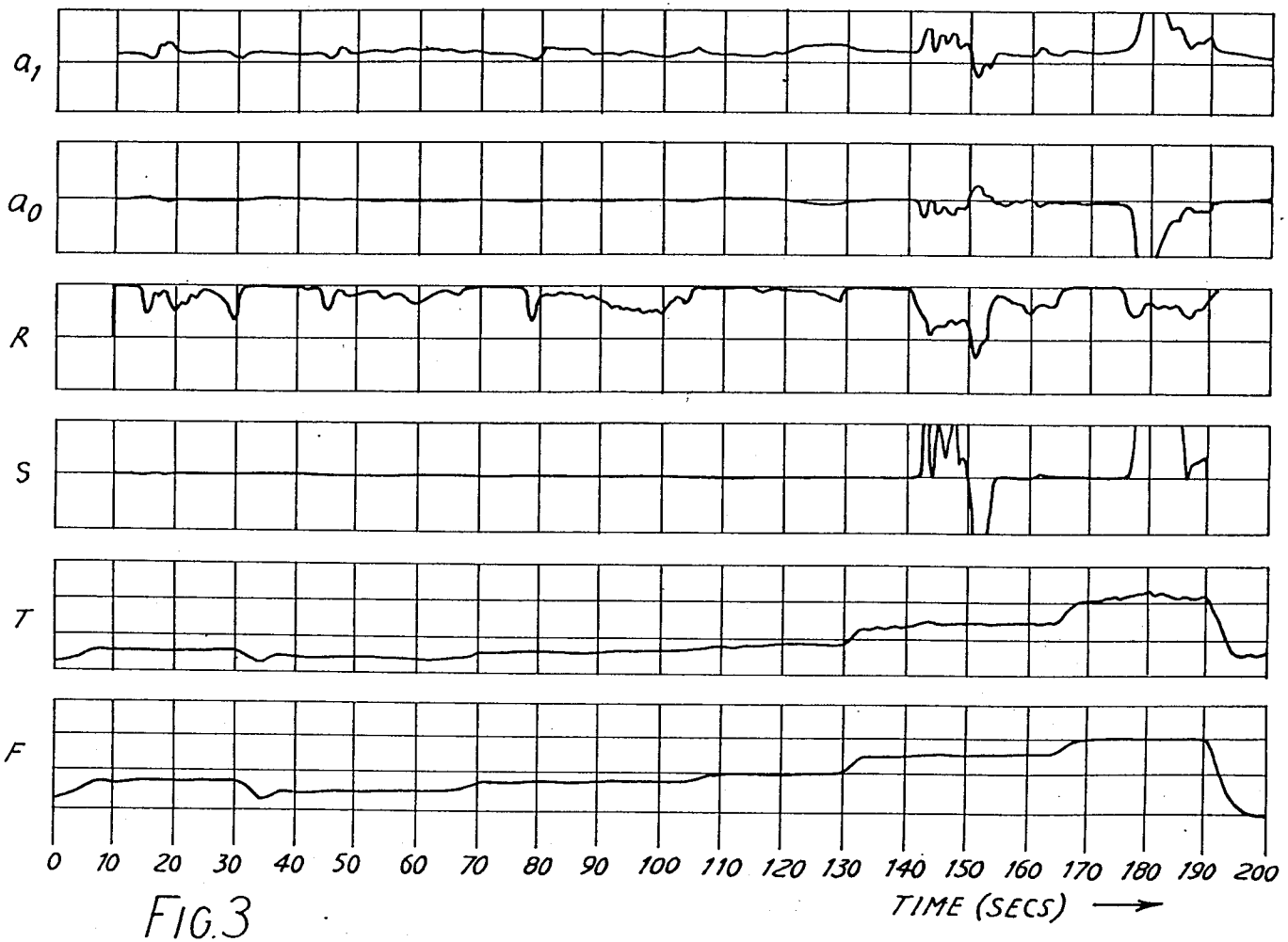
FIGS. 3, 4 and 5 are further time histories including signal outputs
Figure 4:
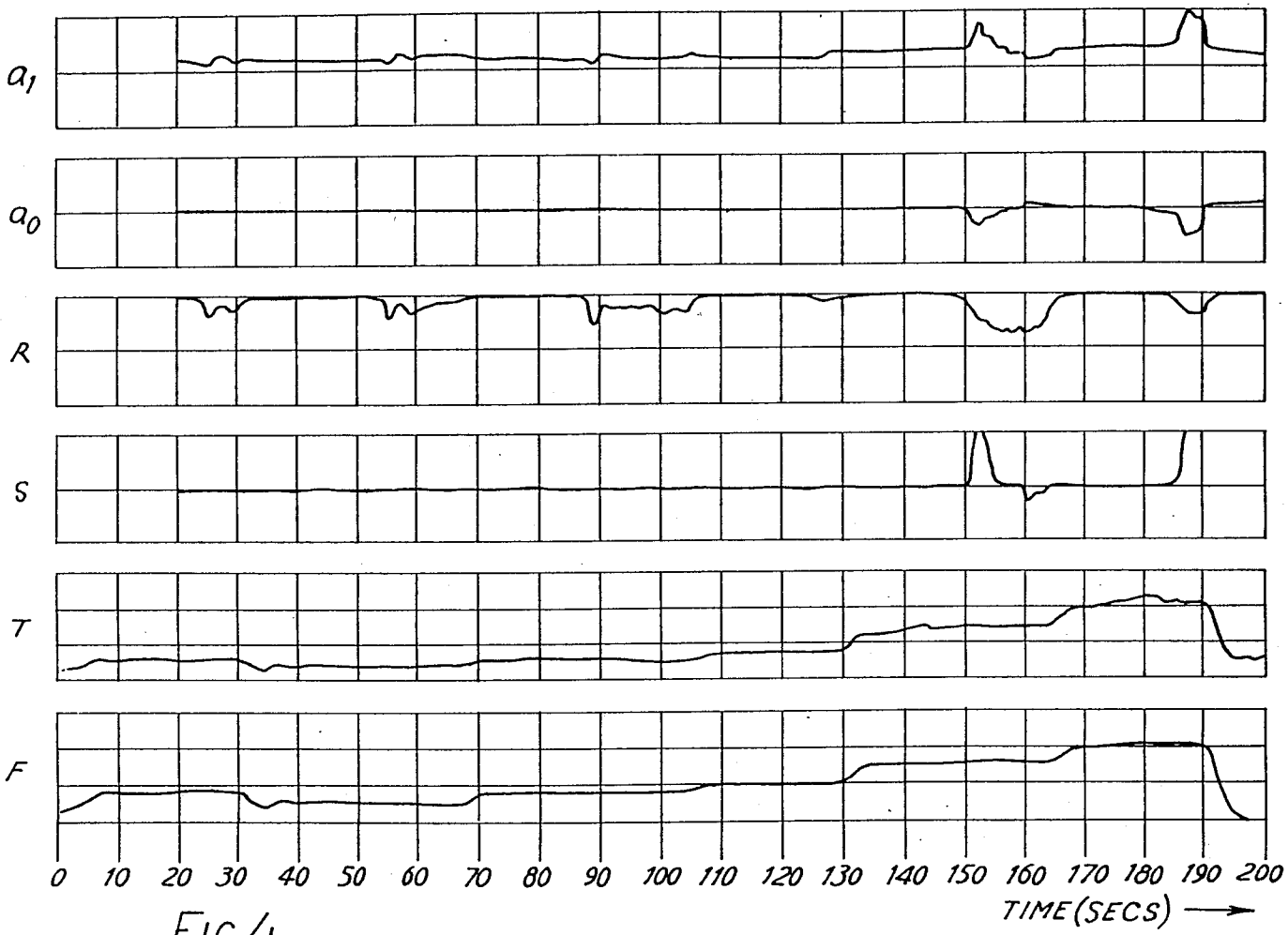

The signal value s is plotted (FIG. 3) is indicatative of drilling events. The fixed mean approach gives an excellent signal to noise ratio. The effect of mean updating period can be seen by comparing the plot of FIG. 4, wherein the period is twice (20s) that for FIG. 3.

Thus it will be realised that a single signal (s) for transmission to the surface has been derived which can be used as a drilling monitor, preferably presented to the drill rig operator together with other standard operating data. The signal provides an indication for example of a roller cone bearing failure and may be further processed to indicate severity of the event. Thus running on after failure may be avoided and should prevent extreme bit damage and the costly operation of raising a detached bit.

Figure 5:
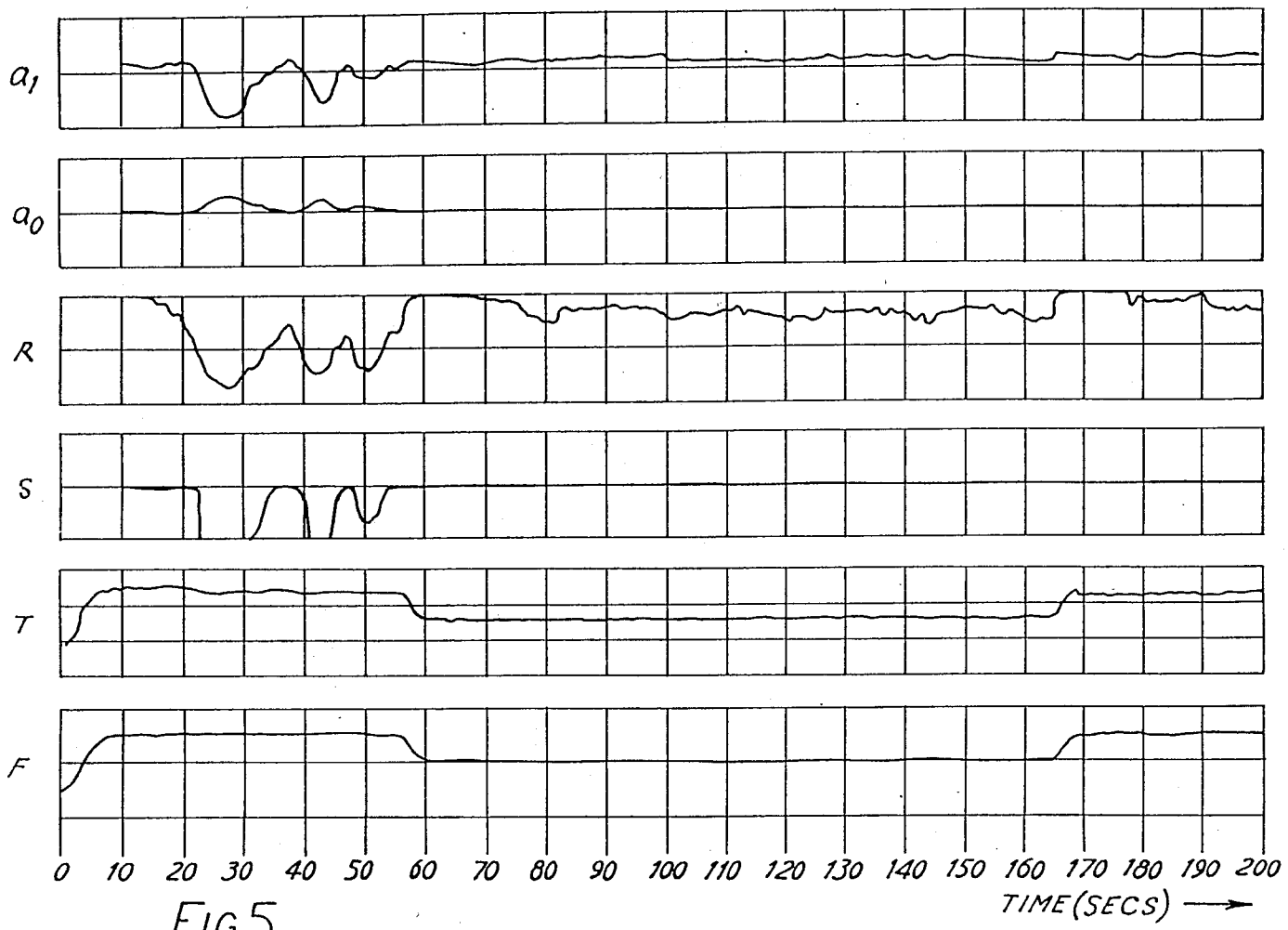

The invention is not restricted to indication of bearing failure. For example in the plot of FIG. 5, events are detected which show a decrease in torque at constant load and cannot therefore be due to increased bearing power consumption. Such an event is likely to be a rock abnormality, such as a fossil embedded in shale.

The method is also likely to be effective to detect other events such as bit balling, lithology changes and bit gauge wear.

Figure 6:
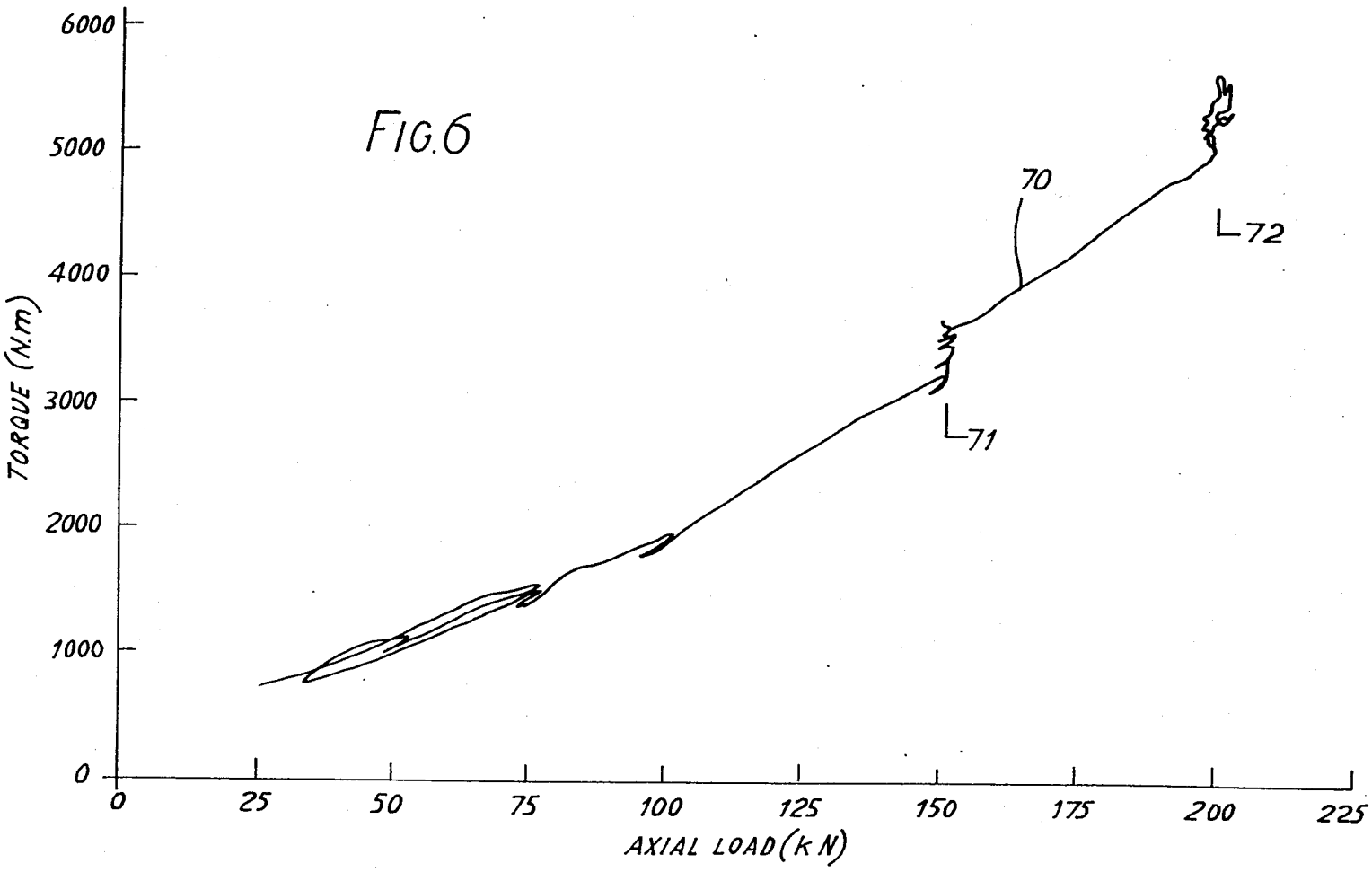
FIG. 6 is a torque/load plot for the history of FIG. 2.

In order that the theoretical basis of the present invention may be further appreciated, consideration will now be given to a plot 70 of measured torque against axial load (FIG. 6). It will be noted that at 71 and 72 (150 KN and 200 KN) torque increases without change in axial load. These changes correspond to drilling events at 130s and 165s respectively, (FIG. 2). The curve fitting algorithm may be applied to plot 70, where it will be realised that $a_1$ represents the slope and $a_0$ the intercept of a straight line fitted over a small portion of the curve. During normal operation $a_0$ and $a_1$ are slowly varying. However, during the events the straightline is almost vertical and $a_0$ and $a_2$ change suddendly. Thus large excursion in $a_0$ and $a_1$ are indicative of drilling events, and the extent of the excursion indicative of severity.

In the example presented above the bearing under examination was successfully cooled and re-used after the test. Hence, the event discussed is much smaller than a total failure, as would be expected in practice yet was readily detected.

What is claimed is:

1. A drilling monitor for sensing downhole drilling conditions, said monitor comprising: downhole transducers for providing signals representative of torque and axial load, downhole computing means adapted to receive the torque and load signals for implementing a drilling model and for computing therefrom coefficients representative of drilling conditions, said model comprising a function relating torque and axial load to one another, and means for combining said coefficients into a surface sendable signal indicative of drilling conditions.

2. A drilling monitor as claimed in claim 1 wherein the computing means is arranged to calculate the coefficients by implementing a curve fitting algorithm of the function to transducer signal samples over a sample period and wherein the computing means continuously updates the coefficients.

3. A drilling monitor as claimed in claim 1 and wherein the computing means is arranged to compute a correlation value between predicted values of torque and load and measured value of torque and load.

4. A drilling monitor as claimed in claim 3, and wherein the means for combining coefficients is adapted to receive the correlation value and further combine it with the coefficients to provide the sendable signal.

5. A drilling monitor as claimed in claim 1 and including signal compression and noise reduction means arranged to act on the sendable signal.

* * * * *